US006644648B1

(12) United States Patent
Goode

(10) Patent No.: US 6,644,648 B1
(45) Date of Patent: Nov. 11, 2003

(54) FEEDER FOR MICROFILM JACKET PRINTER

(75) Inventor: Don Goode, Morton Grove, IL (US)

(73) Assignee: Bell & Howell Imaging Components, L.L.C., Lincolnwood, IL (US)

( * ) Notice: Subject to any disclaimer, the term of this patent is extended or adjusted under 35 U.S.C. 154(b) by 0 days.

(21) Appl. No.: 10/057,829

(22) Filed: Jan. 25, 2002

(51) Int. Cl.[7] ..... B65H 3/52

(52) U.S. Cl. ..... 271/125; 271/124; 271/126; 271/160

(58) Field of Search ..... 271/121, 124, 271/125, 126, 160

(56) References Cited

U.S. PATENT DOCUMENTS 3,869,116 A * 3/1975 Kroeker ..... 271/160
3,948,506 A * 4/1976 Crimmins et al. ..... 271/165
5,244,197 A * 9/1993 Helmstadter ..... 271/35
5,244,198 A * 9/1993 Green ..... 271/125
5,642,877 A * 7/1997 Green ..... 271/35
6,276,679 B1 * 8/2001 Joyce et al. ..... 271/122
6,412,770 B1 * 7/2002 Demmeler ..... 271/94

* cited by examiner

*Primary Examiner*—Donald P. Walsh
*Assistant Examiner*—Kaitlin S Joerger
(74) *Attorney, Agent, or Firm*—McDermott, Will & Emery

(57) ABSTRACT

A feeder apparatus for feeding microfilm jackets to a printer, one at a time from a stack of jackets. The feeder apparatus comprises a tray-like housing, a weight assembly and a brake assembly. The weight assembly includes a pair of pivotally mounted weights which rest on the stack of jackets to create friction between the bottom jacket and a printer feed roller. The brake assembly is used to hold back all but the bottom jacket, as the bottom jacket is transported by the printer feed roller.

14 Claims, 3 Drawing Sheets

FEEDER FOR MICROFILM JACKET PRINTER

The present invention relates to a document feeder for a printer, and in particular, an apparatus for feeding microfilm jackets to a printer. Specifically, the present invention relates to a feeder for holding a stack of microfilm jackets and for feeding the microfilm jackets one at a time from the bottom of the stack to the printer in a controlled, precise manner to avoid multiple feedings or damage to the microfilm jackets.

BACKGROUND OF THE INVENTION

It is well known in the art of printing to use a document feeder to support a stack of documents, and feed these documents to the printer, one at a time from the stack. However, where the document is a microfilm jacket, the jacket typically must be feed into a manual typewriter to be typed by hand. There are no known feeders appropriate for feeding a stack of microfilm jackets to a printer.

Special problems arise when it is attempted to feed microfilm jackets to a printer. Due to the material of which microfilm jackets are made, and due to the size and in particular the thickness of microfilm jackets, known feeders have not been able to adequately feed a stack of microfilm jackets to a printer. Problems encountered with attempting to feed microfilm jackets to a printer are that the jackets either would not feed, or multiple feedings would occur, where more than one jacket is fed at the same time, and/or the microfilm jackets were damaged such as by folding or creasing, etc.

While there are numerous prior art apparatus for feeding documents to a printer, there are no known apparatus that can adequately feed microfilm jackets to a printer. Most printer feeders are designed for feeding paper documents (sheets, envelopes, etc.) to a printer and are typically comprised of a relatively complicated arrangement of rollers, drive means and related components. Again, such prior art devices are wholly inapplicable to microfilm jackets and cannot achieve the advantages and improvements achieved by the present invention.

Accordingly, there is a need for an apparatus for feeding microfilm jackets to a printer, one at a time, in a smooth, efficient and continuous manner, without damaging the jackets. The present invention fulfills such a need.

BRIEF SUMMARY OF THE INVENTION

The present invention is a feeder apparatus for feeding microfilm jackets to a printer, one at a time from a stack of jackets. The feeder apparatus is suitably mounted proximate the infeed area of the printer, and comprises a tray-like housing for holding a stack of microfilm jackets. The feeder apparatus further comprises a weight assembly and a brake assembly, described below.

The weight assembly of the feeder apparatus includes a pair of pivotally mounted weights. These weights rest on the stack of jackets to create friction between the bottom jacket and the printer feed roller. The weights are linked to an arm which allows the weights to be lifted out of the way to assist in loading of the jackets.

The brake assembly of the feeder apparatus is used to hold back all but the bottom jacket, as the bottom jacket is transported by the printer feed roller. The brake assembly comprises a brake roller, pivotally mounted about a shaft, and held tight against the jackets by means of a torsion spring. The braking force of the brake roller is generated by side loading on the roller by means of thrust washers. The amount of breaking force can be adjusted by turning a clamp.

Accordingly, it is the principal object of the present invention to provide an apparatus for feeding microfilm jackets to a printer.

It is also an object of the invention to provide a printer feeder apparatus having a weight assembly and a brake assembly.

It is an additional object of the present invention to provide a feeder having a pair of pivotally mounted weights for resting on a stack of microfilm jackets to create friction between the bottom jacket and a printer feed roller.

It is another object of the present invention to provide a feeder having a pivotally mounted brake roller for providing an adjustable braking force generated by side loading on the roller by means of thrust washers, for holding back all but the bottom microfilm jacket, as the bottom jacket is transported by the printer feed roller.

It is a further object of the present invention to provide a feeder for holding a stack of microfilm jackets and for feeding the microfilm jackets one at a time from the bottom of the stack to the printer in a controlled, precise manner to avoid multiple feedings or damage to the microfilm jackets.

Numerous other advantages and features of the invention will become readily apparent from the detailed description of the preferred embodiment of the invention, from the claims, and from the accompanying drawings in which like numerals are employed to designate like parts throughout the same.

BRIEF DESCRIPTION OF THE DRAWINGS p A fuller understanding of the foregoing may be had by reference to the accompanying drawings wherein.

DETAILED DESCRIPTION OF THE PREFERRED EMBODIMENT OF THE PRESENT INVENTION

Figure 1:
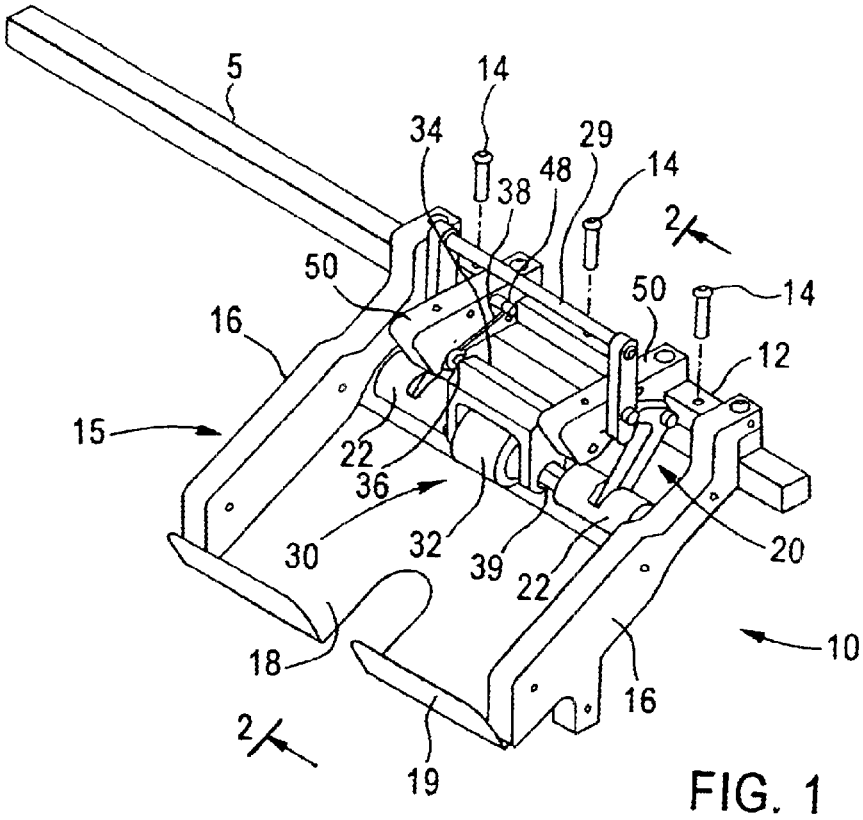
FIG. 1 is a perspective view of the present invention.

While the invention is susceptible of embodiment in many different forms, there is shown in the drawings and will be described herein in detail a preferred embodiment of the invention. It should be understood however that the present disclosure is to be considered an exemplification of the principles of the invention and is not intended to limit the spirit and scope of the invention and/or claims of the embodiment illustrated.

Figure 2:
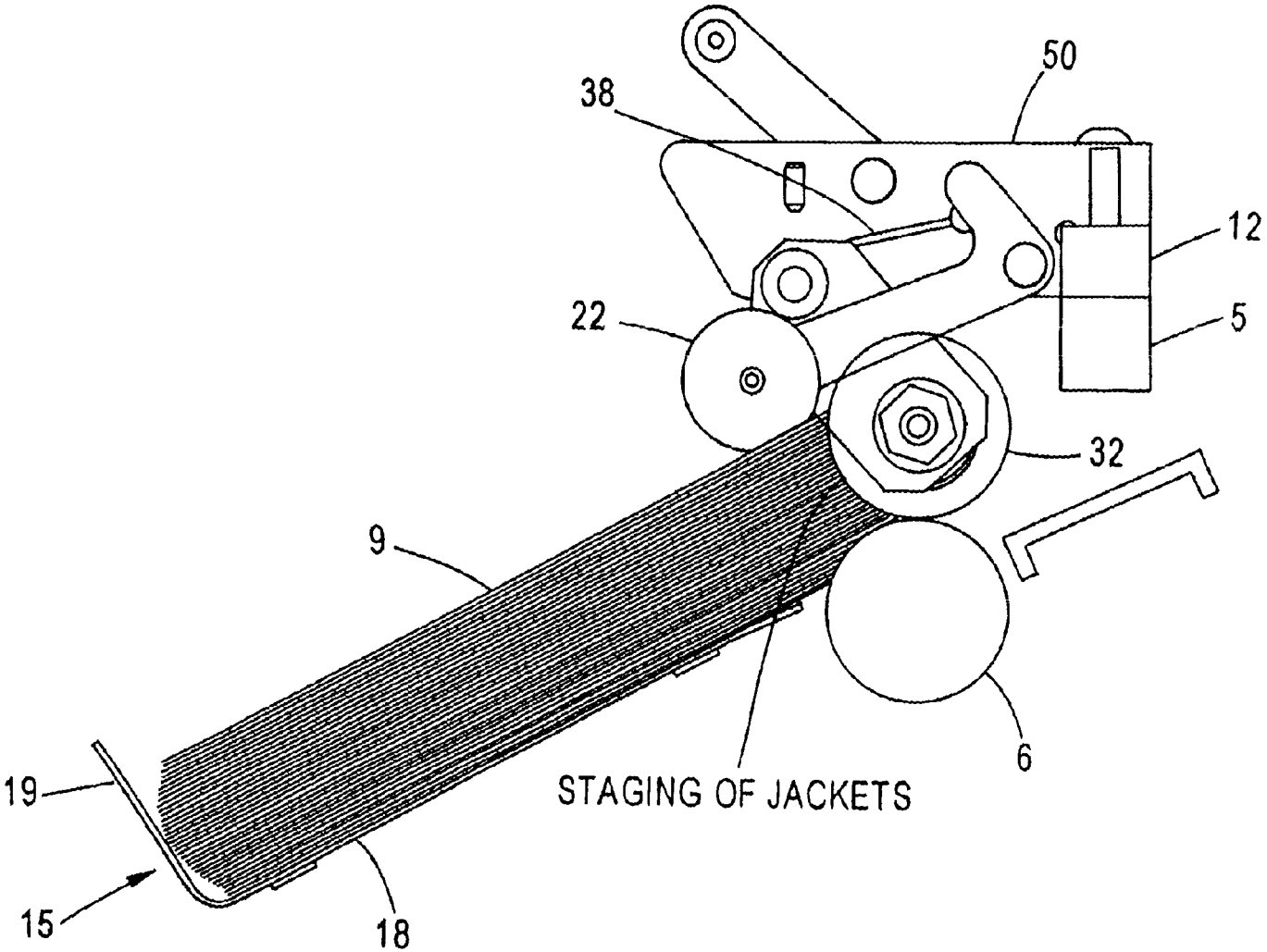
FIG. 2 is a cross sectional view of the present invention taken through line A—A of FIG. 1.

FIG. 1 illustrates the present invention or feeder apparatus 10. Feeder apparatus 10 is mounted to an existing cross bar 5 of a printer (not shown), proximate the infeed area of the printer, or more specifically centered above the printer drive roller 6, as shown in FIG. 2. A mounting bar 12 of the feeder apparatus 10 is secured to the cross bar 5 via suitable fasteners 14 placed through holes in the mounting bar and corresponding holes tapped in the cross bar 5.

The feeder apparatus 10 comprises a tray-like housing 15 for holding a stack of microfilm jackets. Housing 15 comprises two sidewalls 16 suitably secured to mounting bar 12 and extending outwardly and downwardly therefrom, for example, at an angle of approximately twenty-five degrees. Attached to the bottom of sidewalls 16 and spanning the area therebetween is a support plate 18 upon which a stack of microfilm jackets 9 rest, as shown in FIG. 2. The support plate 18 includes an end wall 19 which prevents the microfilm jackets from sliding off the support plate 18.

The feeder apparatus 10 further comprises a weight assembly 20. The weight assembly 20 includes a pair of pivotally mounted weights 22. These weights 22 rest on the stack of microfilm jackets (see FIG. 2) to create friction between the bottom jacket and the printer feed roller 6 (FIG. 2). The weights are set so that there is sufficient friction with a full complement or minimum amount of microfilm jackets in the housing 15. The weights 22 are linked to an arm 29 which allows the weights to be lifted out of the way to assist in loading of the jackets, as will be described in more detail with respect to FIG. 3 below.

The feeder apparatus 10 further comprises a brake assembly 30. The brake assembly 30 is used to hold back all but the bottom microfilm jacket, as the bottom jacket is transported by the printer feed roller 6 (FIG. 2). The brake assembly comprises a brake roller 32, rotatably mounted in a yoke 34, which is pivotally mounted to supports 50, via a shaft 36, and held tight against the jackets by means of a torsion spring 38. The braking force of the brake roller 32 is generated by side loading on the roller 32 by means of thrust washers 37 (see FIG. 4). The amount of breaking force can be adjusted by turning a clamp 39.

FIG. 2 is a cross sectional view of the feeder apparatus 10, taken along line A—A of FIG. 1. As can be seen, feeder housing 15 is mounted to cross bar 5, such that brake roller 32 is operatively associated with printer drive roller 6. A stack of microfilm jackets 9 are located in housing 15. Weights 22 rest upon the top printer jacket, and pivot downward via gravity as the microfilm jackets 9 are feed to the printer. The brake roller 32 is biased against the printer jackets 9 via torsion spring 38.

Figure 3:
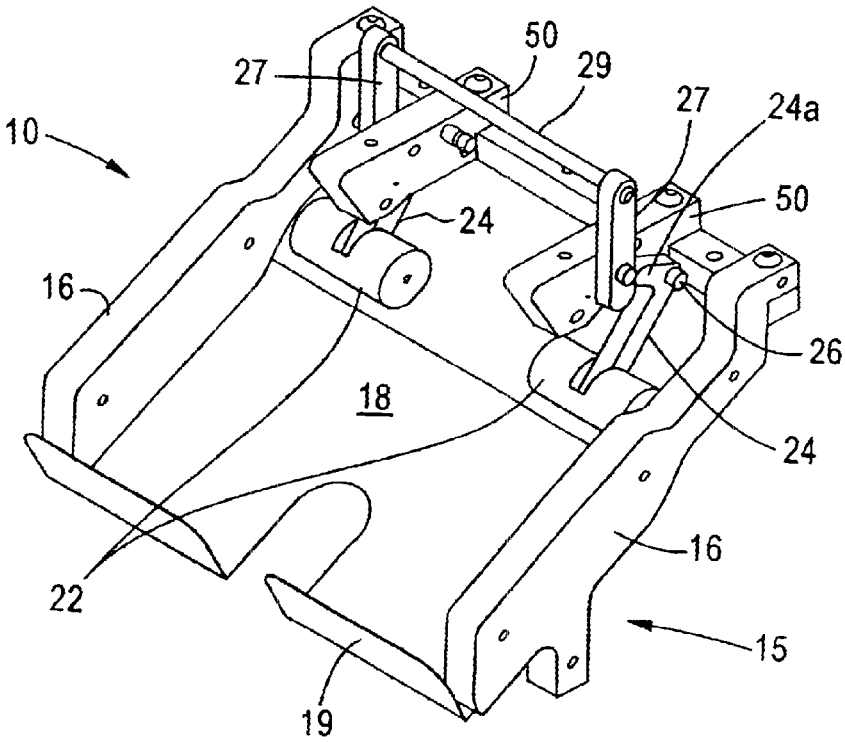
FIG. 3 is a perspective view of the present invention in the absence of the brake assembly.

FIG. 3 illustrates feeder assembly 10 with the weight assembly 20 in the absence of the brake assembly 30. Side walls 16 of housing 15 are mounted to mounting bar 12 and extend therefrom. Similarly, supports 50 are mounted to mounting bar 12 and extend therefrom.

The weights 22 are mounted to arms 24, which in turn are pivotally mounted to supports 50 via pivots 26. Each arm 24 has a cam portion 24a which is positioned proximate lever arms 27. Lever arms 27 are pivotally mounted to supports 50, and are connected via arm 29. When arm 29 is pulled down, or towards end wall 19, lever arms 27 lift cam portion 24a, causing arms 24 to pivot about pivot 26, thus raising weights 22. In this manner, the weights 22 can be raised out of the way to assist in loading of the microfilm jackets 9 into the housing 15.

Figure 4:
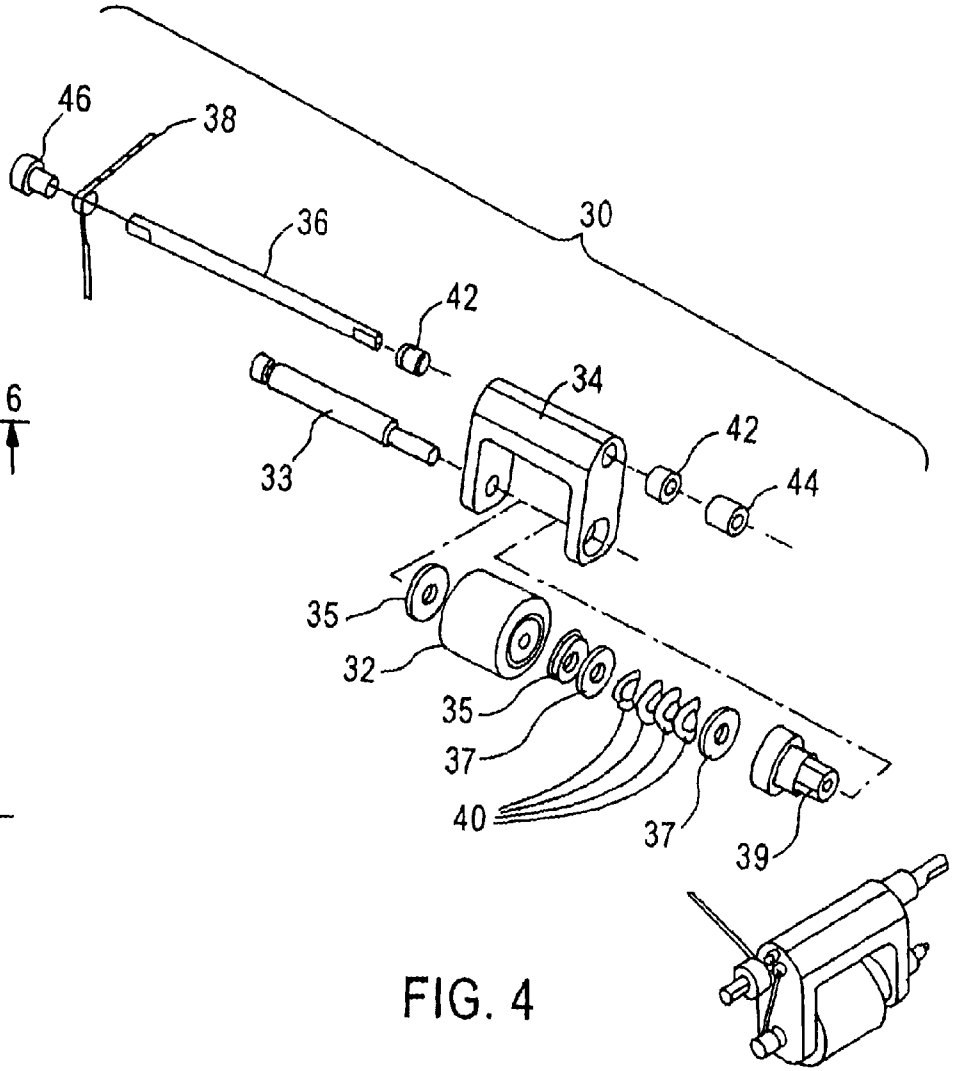
FIG. 4 is an exploded perspective view of the brake assembly of the present invention.

FIG. 4 illustrates an exploded view of the brake assembly. Brake roller 32 is rotatably mounted on a shaft 33, between two arms of yoke 34. The brake roller 32 is preferably composed of a blue urethane compound with a durometer of 35–45. To either side of the brake roller 32 is located a spacer 35. On one side of the brake roller is located a plurality of curved disc springs 40 (four shown), surrounded by two thrust washers 37. Next to the outer thrust washer is located the brake adjustment knob or clamp 39, which extends through a hole in one of the arms of yoke 34.

Figure 5:
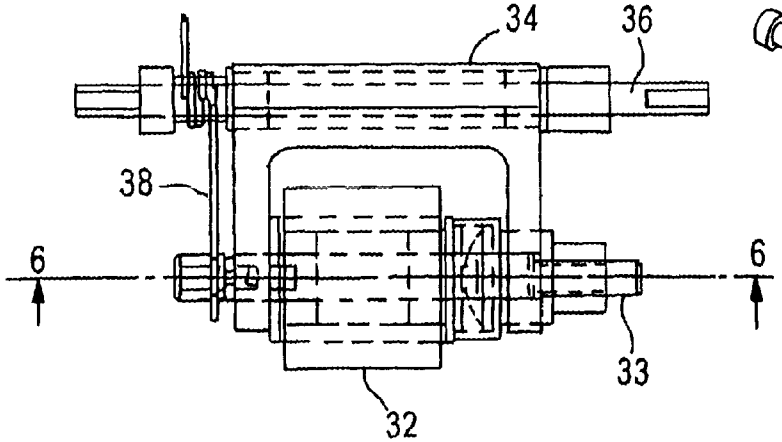
FIG. 5 is a front view of the brake assembly of the present invention.
Figure 6:
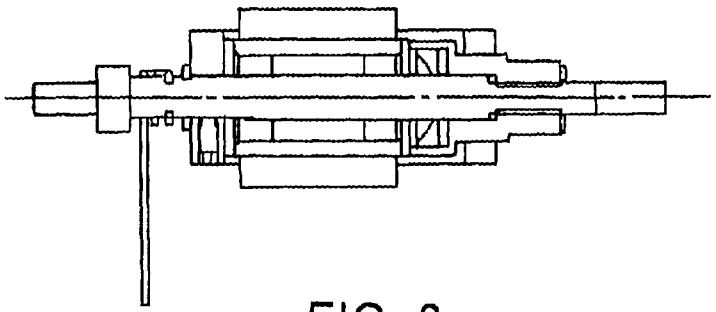
FIG. 6 is a cross sectional view of the brake assembly of the present invention taken through line A—A of FIG. 5.

Yoke 34 is rotatably mounted on shaft 36. A flanged bushing. 42 is provided on shaft 36 at each end of yoke 34. Also provided on shaft 34 on one side of yoke 34 is a spacer 44. On the opposite side of shaft 36 is the torsion spring 38 and a second spacer 46. One end of torsion spring is attached to an anchor 48 (see FIG. 1) in support 50. The other end of torsion spring 38 engages shaft 33, as shown in FIGS. 5 and 6, to provide an outward bias on brake roller 32 to hold brake roller tight against the microfilm jackets 9 in housing 15.

In use, arm 29 is pulled forward to lift weights 22 out of the way as a stack of microfilm jackets 9 are placed on support plate 18 in housing 15. Printer drive roller 6 engages and propels the microfilm jacket at the bottom of the stack into the printer, as a braking force is applied to brake roller 32 such that brake roller holds back and prevents all but the bottom microfilm jacket in the stack from being feed to the printer. Weights 22 rest on the top of the stack of microfilm jackets and provide a force or constant load on the microfilm jackets to ensure sufficient friction between the bottom jacket and the printer drive roller to allow for proper feeding.

It should be understood that the embodiments herein described are merely illustrative of the principles of the present invention. Various modifications may be made by those skilled in the art without departing from the spirit or scope of the claims which follow. Other modifications or substitutions with equivalent elements are also contemplated.

What is claimed is:

1. An apparatus for feeding microfilm jackets to a printer, comprising:

a housing for receiving a stack of microfilm jackets;

a weight assembly for proving a constant force on said stack of microfilm jackets; and a brake assembly for preventing more than one microfilm jacket to be fed from the stack at the same time.

2. The apparatus of claim 1, wherein said weight assembly comprises at least one weight mounted to an arm, said arm being pivotally mounted to a support.

3. The apparatus of claim 2, wherein said arm includes a cam portion, and wherein said weight assembly further comprises a lever for engaging said cam portion thereby lifting said at least one weight.

4. The apparatus of claim 1, wherein said brake assembly comprises a brake roller which receives a side loading braking force.

5. The apparatus of claim 4, wherein said side loading braking force is created by braking elements including thrust washers.

6. The apparatus of claim 4, wherein said side loading braking force is adjustable via a clamping element.

7. The apparatus of claim 4, wherein said brake roller is biased against a side of said stack of microfilm jackets.

8. The apparatus of claim 1, wherein said housing extends outwardly and downwardly from said printer.

9. The apparatus of claim 1, wherein said housing extends outwardly and downwardly from said printer at an angle of approximately twenty-five degrees.

10. A microfilm jacket feeder for a printer having a printer drive roller, said microfilm jacket feeder comprising:

a housing mounted proximate said printer drive roller, said housing configured to receive a stack of microfilm jackets;

a pair of weights, said pair of weights adapted to rest upon said stack of microfilm jackets in said housing, wherein said weights provide a constant load on said stack of microfilm jackets to provide sufficient friction between said printer drive roller and a microfilm jacket in contact with said printer drive roller; and a brake roller mounted adjacent said printer drive roller and adapted to be biased against said stack of microfilm jackets, wherein said brake roller prevents all but said microfilm jacket in contact with said printer drive roller from being feed into said printer.

11. The apparatus of claim 10, wherein said housing extends outwardly and downwardly from said printer.

12. The apparatus of claim 10, wherein said housing extends outwardly and downwardly from said printer at an angle of approximately twenty-five degrees.

13. An apparatus for feeding microfilm jackets to a printer, comprising:

a housing for receiving a stack of microfilm jackets;

a weight assembly for proving a force on said stack of microfilm jackets; and a brake assembly for preventing more than one microfilm jacket to be fed from the stack at the same time, the brake assembly comprising a brake roller which receives a braking force created by thrust washers.

14. A microfilm jacket feeder for a printer having a printer drive roller, said microfilm jacket feeder comprising:

a housing mounted proximate said printer drive roller, said housing configured to receive a stack of microfilm jackets;

a pair of weights, said pair of weights adapted to rest upon said stack of microfilm jackets in said housing, wherein said weights provide a constant load on said stack of microfilm jackets to provide sufficient friction between said printer drive roller and a microfilm jacket in contact with said printer drive roller; and a brake roller mounted adjacent said printer drive roller and adapted to be biased against said stack of microfilm jackets, wherein said brake roller prevents all but said microfilm jacket in contact with said printer drive roller from being feed into said printer, wherein the brake roller receives a braking force created by thrust washers.

* * * * *